US006307474B1

(12) United States Patent
Lian et al.

(10) Patent No.: US 6,307,474 B1
(45) Date of Patent: Oct. 23, 2001

(54) MAGNETOMECHANICAL ELECTRONIC ARTICLE SURVEILLANCE SYSTEM AND METHOD USING SIDEBAND DETECTION

(75) Inventors: Ming-Ren Lian; Hubert A. Patterson, both of Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/643,463

(22) Filed: Aug. 22, 2000

(51) Int. Cl.[7] ..... G08B 13/14

(52) U.S. Cl. ..... 340/572.6; 340/572.3; 340/572.2

(58) Field of Search ..... 340/572.6, 572.3, 340/572.2, 572.1, 551, 572.5; 148/121, 103, 105

(56) References Cited

U.S. PATENT DOCUMENTS

| | | | | |
|---|---|---|---|---|
| 4,249,167 | * | 2/1981 | Purinton et al. | 340/572.2 |
| 4,510,489 | | 4/1985 | Anderson et al. | 340/572 |
| 4,510,490 | | 4/1985 | Anderson et al. | 340/572 |
| 4,660,025 | | 4/1987 | Humphrey | 340/572 |
| 5,351,033 | * | 9/1994 | Liu et al. | 340/572.6 |
| 5,602,527 | * | 2/1997 | Suenaga | 340/551 |
| 5,684,459 | * | 11/1997 | Liu et al. | 340/572.1 |
| 5,729,200 | * | 3/1998 | Copeland et al. | 340/551 |

* cited by examiner

*Primary Examiner*—Benjamin C. Lee
(74) *Attorney, Agent, or Firm*—Rick F. Comoglio; Paul T. Kashimba

(57) ABSTRACT

An electronic article surveillance (EAS) system and method utilizing two transmitted signals to generate and detect a marker signal is provided. The first signal is set at or near the resonance of the marker so its energy can be transmitted and stored in the marker. The second signal is a low frequency magnetic field that changes the resonant frequency of the marker. Because the marker's resonant frequency is constantly varying in response to the low frequency magnetic field, the marker's response to the first transmitted signal also changes. As a result, the marker performs a modulation on the first transmitted signal. Detection of a sideband of the modulated signal indicates the presence of the marker within an interrogation zone formed by the two transmitted signals. Multiple interrogation zones can be implemented by transmitting multiple low frequency signals, one low frequency signal for each interrogation zone.

14 Claims, 8 Drawing Sheets

MAGNETOMECHANICAL ELECTRONIC ARTICLE SURVEILLANCE SYSTEM AND METHOD USING SIDEBAND DETECTION

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to magnetomechanical electronic article surveillance systems and methods, and more particularly to the generation and detection of sideband signals from a magnetomechanical marker.

2. Description of the Related Art

Electronic article surveillance (EAS) systems are well known for the prevention or deterrence of unauthorized removal of articles from a controlled area. In a typical EAS system, markers designed to interact with an electromagnetic field located at the exits of the controlled area are attached to articles to be protected. If a marker is brought into the electromagnetic field or "interrogation zone", the presence of the marker is detected and appropriate action is taken, such as generating an alarm.

Several types of EAS systems and markers are presently known. In one type, the marker includes either an antenna and diode, or an antenna and capacitors forming a resonant circuit. When placed in an electromagnetic field transmitted by the interrogation apparatus, the marker having an antenna and diode generates harmonics of the interrogation frequency in the receive antenna; the resonant circuit marker causes an increase in absorption of the transmitted signal so as to reduce the signal in the receiving coil. Detection of the harmonics or the signal level change in the receive coil indicates the presence of the marker.

One of the problems with harmonic generating markers and resonant circuit markers is the difficulty with detection at remote distances. Another problem with harmonic generating and resonant circuit markers is the difficulty in distinguishing the marker signal from pseudo signals generated by other items such as belt buckles, pens, hair clips, and other metallic objects.

U.S. Pat. No. 4,660,025 discloses an improved harmonic generating marker utilizing a magnetic material having a magnetic hysteresis loop that exhibits a large Barkhausen discontinuity. The magnetic material, when exposed to an external magnetic field whose field strength in the direction opposing the instantaneous magnetic polarization of the material exceeds a predetermined threshold value, results in a regenerative reversal of the magnetic polarization of the material. The result of utilizing markers having magnetic material exhibiting a large Barkhausen discontinuity is the production of high order harmonics having amplitudes that are more readily detected. However, false alarms are still possible utilizing these improved harmonic generating markers.

Harmonic generating markers rely on non-linear behavior of the magnetic materials to generate the harmonic signals needed for detection. A more robust EAS system utilizes magnetomechanical or magnetoacoustic markers in which magnetic resonators operate in a linear magnetic response region.

U.S. Pat. Nos. 4,510,489 and 4,510,490 each disclose an electronic article surveillance (EAS) system and associated magnetomechanical marker. The magnetomechanical marker includes a resonator element made of a magnetostrictive material, which in the presence of a biasing magnetic field, resonates in response to a specific frequency. The biasing magnetic field is typically provided by a ferromagnetic element disposed adjacent the magnetostrictive material. Upon being magnetized, the ferromagnetic element provides a biasing magnetic field that enables the magnetostrictive material to resonate at its preselected resonance frequency. The marker is detected by detecting the change in coupling between an interrogating coil and a receiving coil at the marker's resonant frequency.

Because the marker is interrogated and detected at the marker's resonant frequency, the transmitted interrogation frequency interferes with detection of the marker. Therefore, a burst or pulsed magnetomechanical EAS system is preferred. In the pulsed system, a transmitter generates a signal at a preselected frequency, such as 58 kHz, for a fixed duration to excite the marker. The receiver is disabled for the transmit period. The receiver is then activated to detect the resonant envelope of the marker as it decays over time, commonly referred to as "ring-down". A marker having a high quality factor (Q) response is required for good detection in a pulsed system, resulting in few false alarms and detection from remote distances. While, a pulsed magnetomechanical is the highest quality and highest functioning EAS system available to date, there is room for improvement.

After a transmit pulse is generated, the receiver typically includes an initialization period after activation which causes the receiver's detection window to be delayed slightly. In addition, due to the finite length of the transmit pulse, the marker may not have sufficient time to build up full energy before the transmitter is deactivated, and the marker may begin to ring-down from a lower energy level. The detection window is thus shifted to a time when the marker has already lost some of its available stored energy, making detection more difficult. An improved signal generation and detection method for magnetomechanical markers is desired.

BRIEF SUMMARY OF THE INVENTION

Sideband detection can be an improvement over harmonic and field disturbance detection. In the detection of harmonics, or in detection of the fundamental frequency, the carrier signal itself is a source of noise. The signals that are being detected from an EAS marker are small, so even a small amount of carrier noise masks the desired signal. With sideband detection, the carrier frequency is not a significant noise source masking the detection of the sidebands.

In a first aspect of the present invention, an electronic article surveillance system using a magnetomechanical marker for generating and detecting modulated signals is provided. A first signal at a first frequency and a second signal at a second frequency are transmitted into an interrogation zone. The second frequency is a magnetic field lower in frequency than the first frequency. A magnetomechanical marker having a magnetostrictive material is attached to an article that passes through the interrogation zone. The magnetostrictive material of the marker resonates at the first frequency when biased to a predetermined level by a magnetic field. The second signal is a low frequency magnetic field that effects the bias of the marker causing the resonant frequency of the marker to shift about the first frequency according to the second signal's low frequency alternating magnetic field. In terms of modulation, the first signal is a carrier signal, and the second signal is a modulation signal for the modulation of the two signals performed by the marker. The modulated signals form sidebands of the first frequency offset from the first, or carrier frequency by multiples of the second, or modulation frequency. Detection of the sideband signal by suitable receiving equipment indicates the presence of the marker in the interrogation zone.

In a second aspect of the present invention, a method of enhancing the detection of a magnetomechanical electronic article surveillance (EAS) marker of a type having a magnetostrictive ferromagnetic element that resonates at a preselected frequency when exposed to a biasing magnetic field is provided. The method includes transmitting a first signal at a first frequency and a second signal at a second frequency into an interrogation zone. The second signal is lower in frequency than the first signal. Providing an EAS marker in the interrogation zone having a magnetostrictive material that resonates at the first frequency when biased to a predetermined level by a magnetic field. The second signal is a low frequency magnetic field that causes the resonant frequency of the marker to shift about the first frequency according to the second signal's alternating magnetic field resulting in the modulation of the first signal and the formation of sidebands of the first frequency. Detection of a sideband indicates the presence of a valid marker in the interrogation zone.

In the above aspects of the present invention, the biasing magnetic field for the magnetostrictive material can be a transmitted magnetic field, such as produced by utilizing the second signal, or a different transmitted magnetic field. Preferably the biasing magnetic field is a dc magnetic field which can be implemented by a magnetizable ferromagnetic member disposed adjacent the magnetostrictive material. The ferromagnetic member provides the biasing dc magnetic field when magnetized.

In one embodiment of the present invention, the first frequency is about 58 kHz, and the second frequency is about 200 Hz. While these frequencies are one example, other frequencies can be implemented. The first and second signals can be continuous wave (CW) and the sideband detection can be performed synchronously with the transmission of the first and second signals. Synchronous detection eliminates the need for complex switching in the transmitter or receiver. Alternately, the first signal, the second signal, or both signals can be pulsed. In addition, the magnetostrictive ferromagnetic material of the marker mixes the first and second signals in a linear magnetic response region of the material.

Accordingly, it is an object of the present invention to provide a magnetomechanical EAS system of the type having a magnetostrictive material that resonates at a first frequency when biased by a magnetic field, and that mixes the first frequency and a second frequency producing a detectable sideband of the first frequency.

It is a further object of the present invention to provide a magnetomechanical EAS system of the type having a magnetostrictive material that resonates at a first frequency when biased by a magnetic field, and that in a linear magnetic response region, mixes the first frequency and a second frequency producing a detectable sideband of the first frequency.

It is yet another object of the present invention to provide a method of enhancing the detection of a magnetomechanical electronic article surveillance (EAS) marker of a type having a magnetostrictive ferromagnetic element that resonates at a preselected frequency when exposed to a biasing magnetic field, and that mixes the first frequency and a second frequency producing a detectable sideband of the first frequency.

Other objectives, advantages, and applications of the present invention will be made apparent by the following detailed description of the preferred embodiment of the invention.

DETAILED DESCRIPTION OF THE INVENTION

Figure 1:
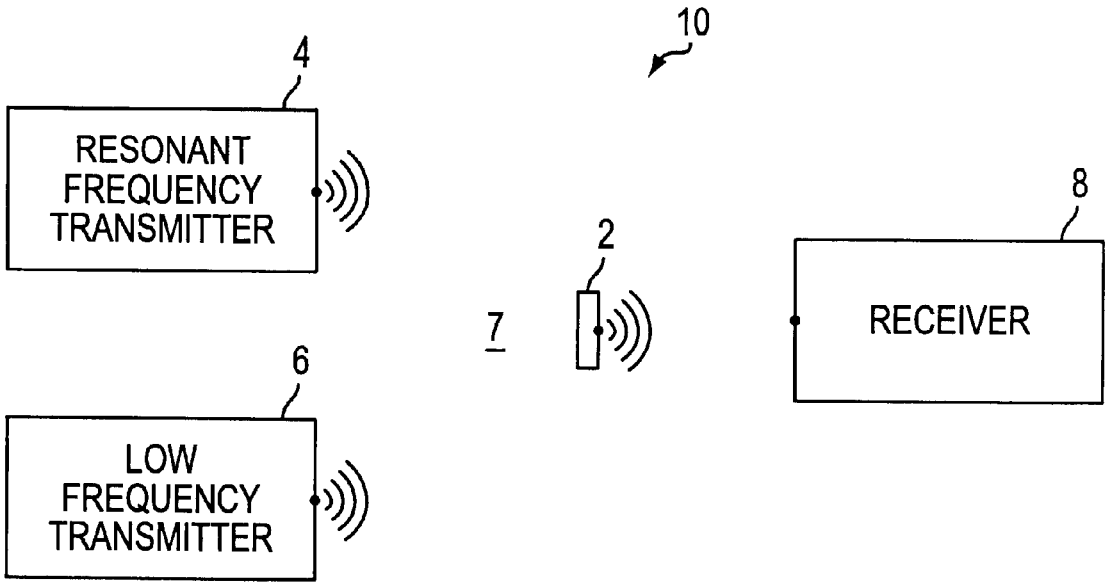
FIG. 1 is a block diagram of an electronic article surveillance system incorporating the present invention.

Referring to FIG. 1, an EAS system in accordance with the present invention is illustrated generally at 10, comprising a magnetomechanical marker 2, a resonant frequency transmitter 4, a low frequency transmitter 6, an interrogation zone 7, and a receiver 8. Interrogation zone 7 is typically positioned in the exit of a controlled area to prevent removal of items to which marker 2 may be attached. As fully described below, resonant frequency transmitter 4 and low frequency transmitter 6 both transmit into interrogation zone 7. When an active magnetomechanical marker 2 is placed into the interrogation zone 7, the marker generates sidebands due to the marker's mixing of the two transmitted frequencies. At least one sideband is detected by receiver 8, indicating the presence of marker 2 in the interrogation zone 7.

Figure 2:
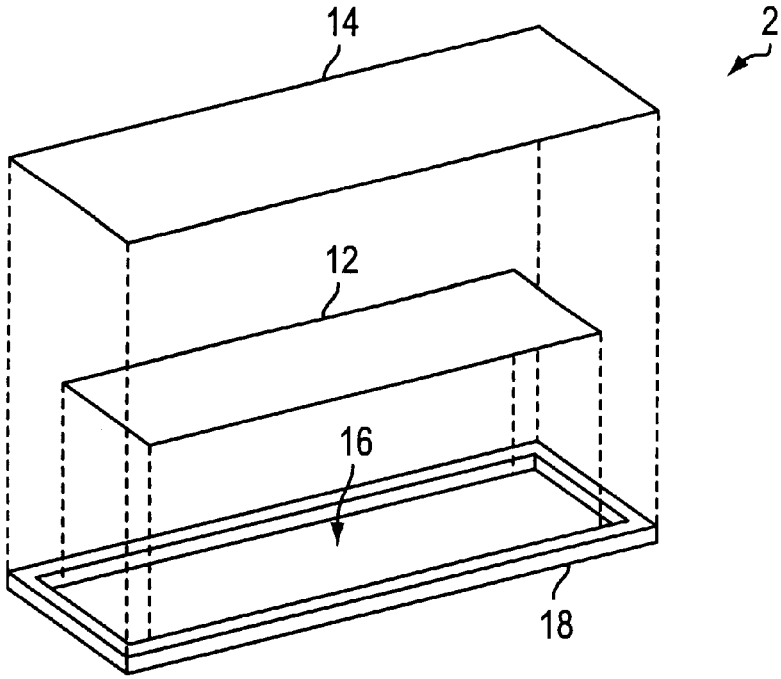
FIG. 2 is an exploded perspective view of one embodiment for a marker in accordance with the present invention.

Referring to FIG. 2, magnetomechanical marker 2 includes a resonator 12 made of a magnetostrictive ferromagnetic material adapted to resonate mechanically at a preselected resonance frequency when biased by a magnetic field. The frequency transmitted by transmitter 4 is preselected to be about the resonant frequency of marker 2. In one embodiment, biasing element 14, disposed adjacent to resonator 12, is a high coercive ferromagnetic element that upon being magnetized, magnetically biases resonator 12 permitting it to resonate at the preselected resonance frequency. Alternately, instead of biasing element 14, resonator 12 can be biased by a low frequency magnetic field transmitted by transmitter 6, or by a different magnetic field (not shown). Resonator 12 can be placed into cavity 16 in housing member 18 to prevent interference with the mechanical resonance. Further details on marker 2 are available in U.S. Pat. Nos. 4,510,489 and 4,510,490.

Figure 3:
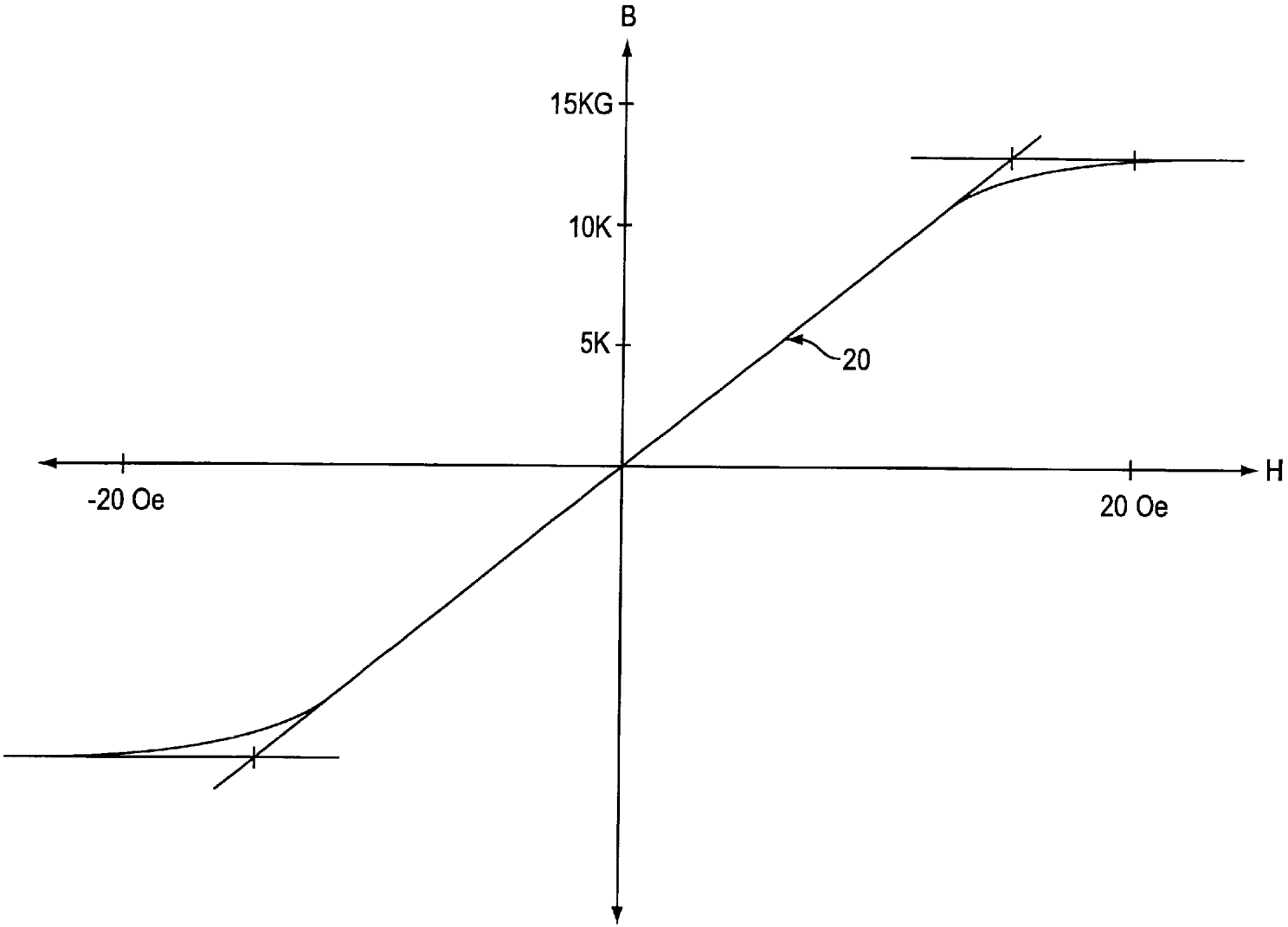
FIG. 3 is a graph showing a BH loop for one embodiment of a magnetostrictive ferromagnetic resonator used with the present invention.

Referring to FIG. 3, a representative electric-magnetic field (BH) loop is illustrated for the magnetostrictive material of resonator 12 with the B axis in the vertical direction and the H axis in the horizontal direction, as known in the art. While many alternate sized resonators can be annealed and implemented in accordance with the present invention, in one example, resonator 12 is a magnetic ribbon about 0.5 inches wide and about 1.5 inches long that is annealed in a magnetic field having a transverse anisotropy of about 9 oersted (Oe). The B-H loop measurement of FIG. 3 shows that the 1.5-inch piece saturates at about +/−14 Oe, and is substantially linear between the saturation points, as indicated at 20.

Figure 4:
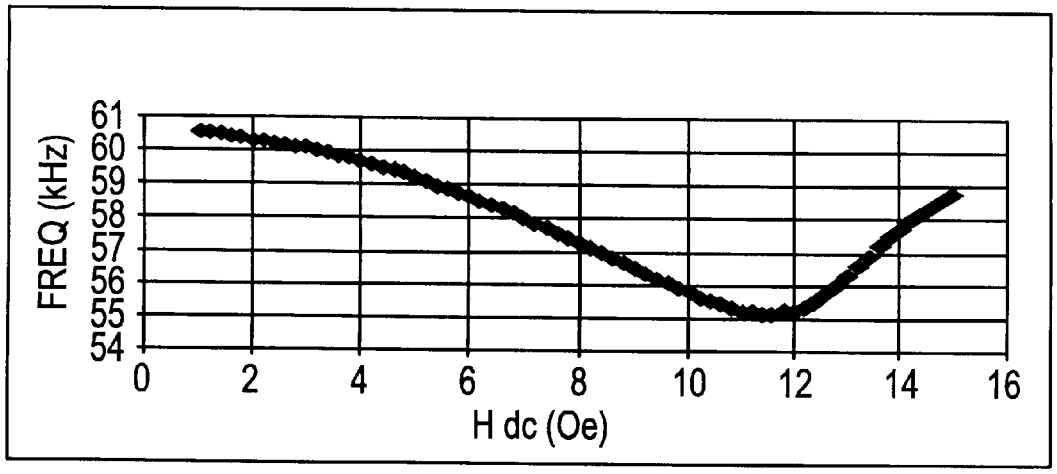
FIG. 4 is a graph showing the resonant frequency of the resonator of FIG. 3 as a function of external magnetic field strength.

The resonant frequency of the ribbon illustrated in FIG. 3 is dependent upon the level of the external dc magnetic field applied, as illustrated in FIG. 4. The resonance starts at about 60.6 kHz, and gradually decreases with the increase of the magnetic field, reaching a minimum of 355 kHz at about 12 Oe. The frequency then increases quickly toward 60.5 kHz as the material reaches its magnetic saturation.

Figure 5:
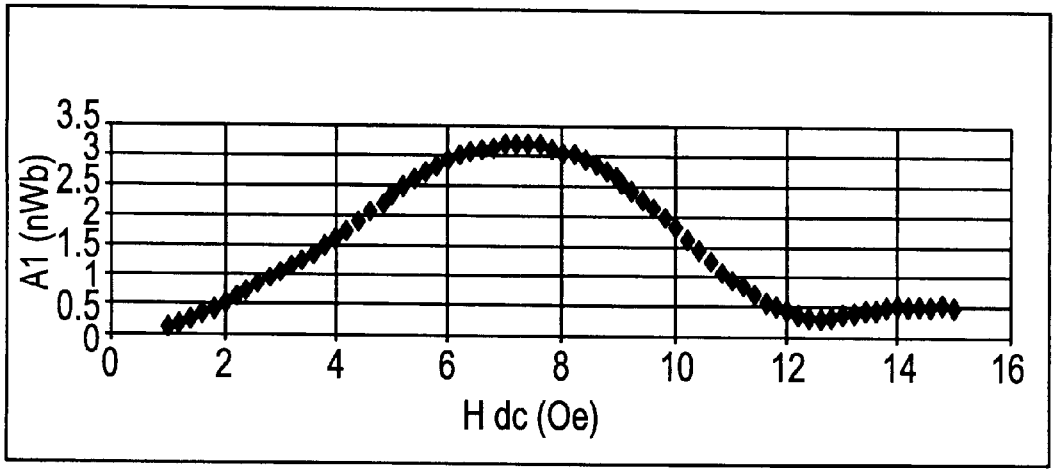
FIG. 5 is a graph showing the amplitude of the signal from the resonator of FIG. 4 as a function of external magnetic field strength.

Referring to FIG. 5, the A1 signal amplitude as a function of the external magnetic field strength is illustrated. The A1 amplitude is the marker signal output measured 1 millisecond after the excitation transmitter is turned off. The amplitude increases with the magnetic field strength, reaching a maximum of about 3.2 nWb at about 7.4 Oe field. The signal then decreases gradually with further increase in the dc magnetic field toward saturation. For proper marker operation, the resonator 12 needs to be biased at about 6 to 7 Oe. In this region, as illustrated in FIG. 4, the resonant frequency shifts by about 650 Hz per Oe of field strength. Preferably, an adjacent high coercive magnetic biasing element 14, shown in FIG. 2, provides the bias magnetic field.

Figure 6:
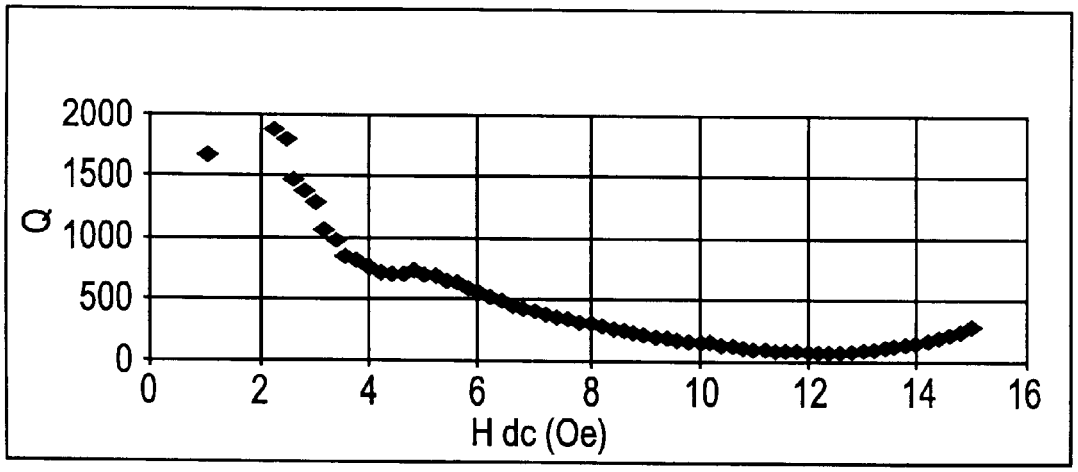
FIG. 6 is a graph showing the quality factor Q of the resonator of FIG. 4 as a function of external magnetic field strength.

Referring to FIG. 6, the quality factor (Q) is illustrated as a function of the external magnetic field strength. The Q is an indication of how lossy the resonator is. The higher the Q, the lower loss the resonator has, and the longer the ring-down time will be after the transmitter is turned-off. The resonator's Q decreases with the bias dc magnetic field until reaching a minimum at about 12 Oe.

Figure 7:
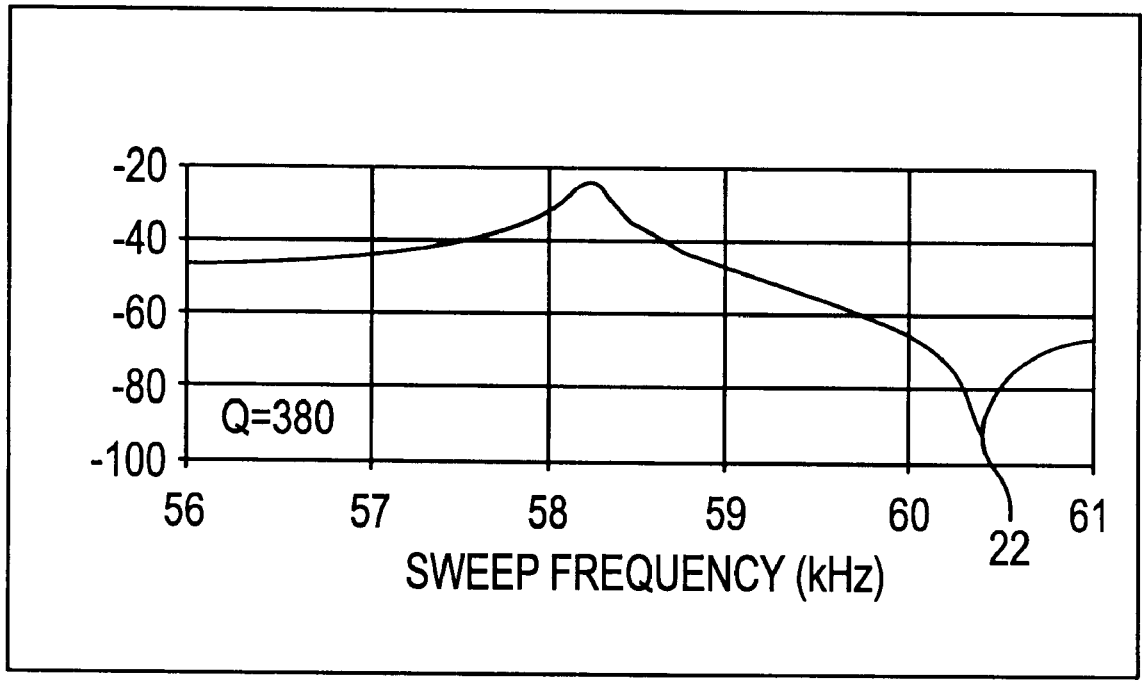
FIG. 7 is a graph showing the frequency response of a marker in accordance with the present invention.

Referring to FIG. 7, the frequency response of marker 2 with resonator 12 as described above is illustrated. The relative marker signal level on the vertical axis is plotted against swept frequency on the horizontal axis. In this embodiment, the resonant frequency is 58.2 kHz, the Q is 380. The anti-resonant frequency shown at 22 is due to the magneto-mechanical coupling. From above, we know that the resonant frequency shifts about 650 Hz per oersted of external magnetic field. The application of a low frequency alternating magnetic field shifts the resonant frequency, and along with the resonant excitation frequency, results in a fluctuation in peak marker response that is synchronous with the low frequency magnetic field. The marker response shows up as a modulation of the resonant or "carrier" frequency by the low frequency modulation magnetic field.

Figure 8:
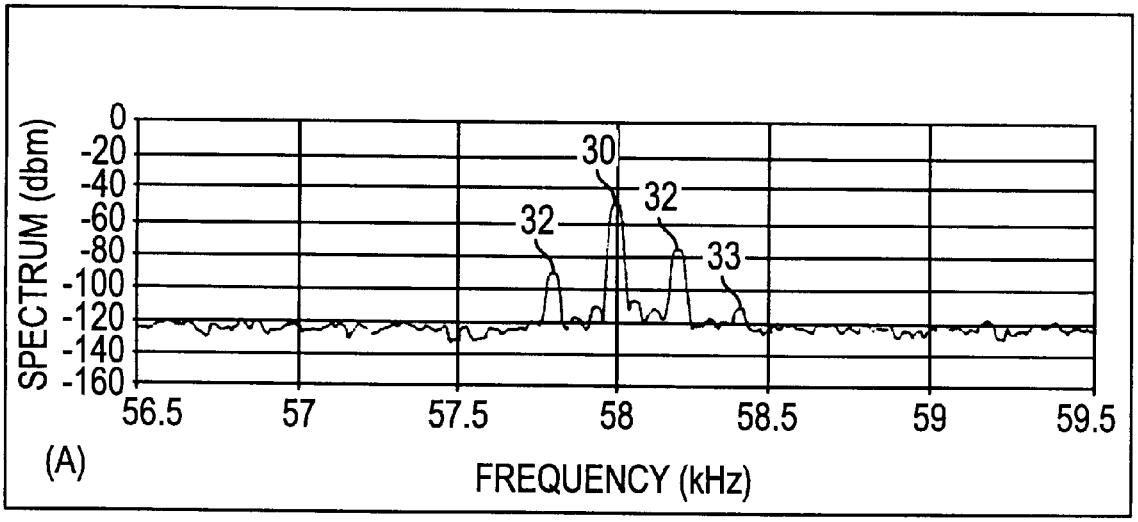
FIG. 8 is a graph showing the mixing response of a marker in accordance with the present invention on a 58 kHz carrier frequency and a 200 Hz modulating signal.

Referring to FIG. 8, the mixing response on a 58 kHz carrier frequency and a 200 Hz modulating signal is illustrated for a marker 2 made in accordance with the present invention. The field strength of the 58 kHz carrier is about 0.58 mOe, and the field strength of the 200 Hz modulation frequency is about 9.76 mOe. The resonant frequency 30 and the first sidebands 32, resulting from the modulation are clearly visible, along with a second sideband 33. The first sidebands 32 are +/−200 Hz away from the fundamental or resonant frequency 30 as expected. As described above, the resonator 12 is biased by a dc magnetic field of about 6 to 7 Oe. Referring back to FIG. 3, the resonator 12 is performing a modulation while operating in a linear magnetic response region indicated by 20.

Figure 9:
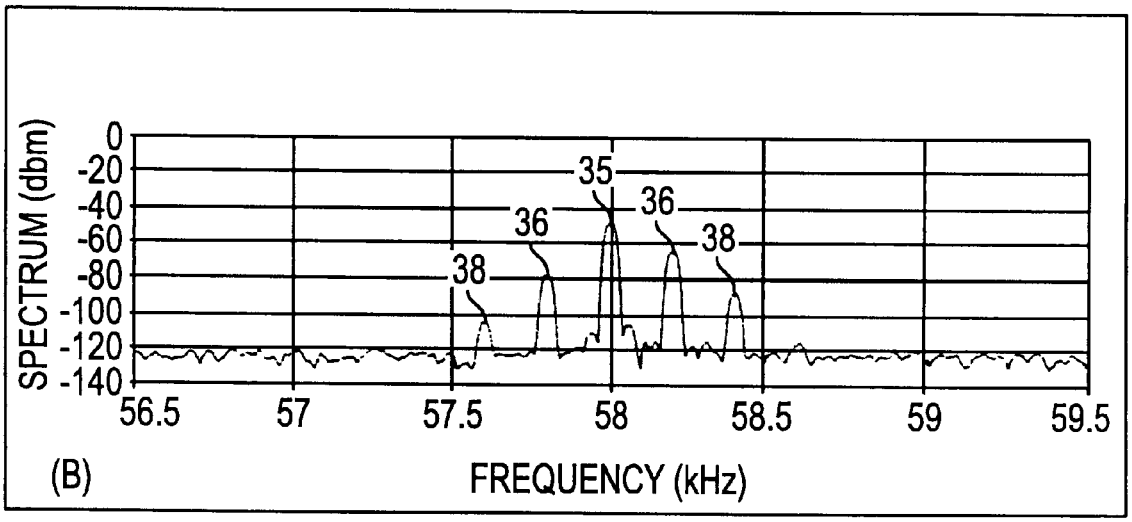
FIG. 9 is a graph showing the mixing response of a marker in accordance with the present invention on a 58 kHz carrier frequency and a 200 Hz modulating signal having a higher field strength than that of FIG. 8.

Referring to FIG. 9, the mixing response on a 58 kHz carrier frequency at 0.58 mOe field and a 200 Hz modulating signal is illustrated for a marker 2 made in accordance with the present invention. As in FIG. 8, the carrier frequency of 58 kHz is at a field level of 0.58 mOe. The 200 Hz modulation frequency is at a higher field level of 38.9 mOe. The resonant frequency 35 and the first sidebands 36 at +/−200 Hz from the fundamental or resonant frequency 35, as well as the second sidebands 38 at +/−400 Hz from the resonant frequency 35, are clearly visible with the higher field strength of the low frequency signal.

Figure 10:
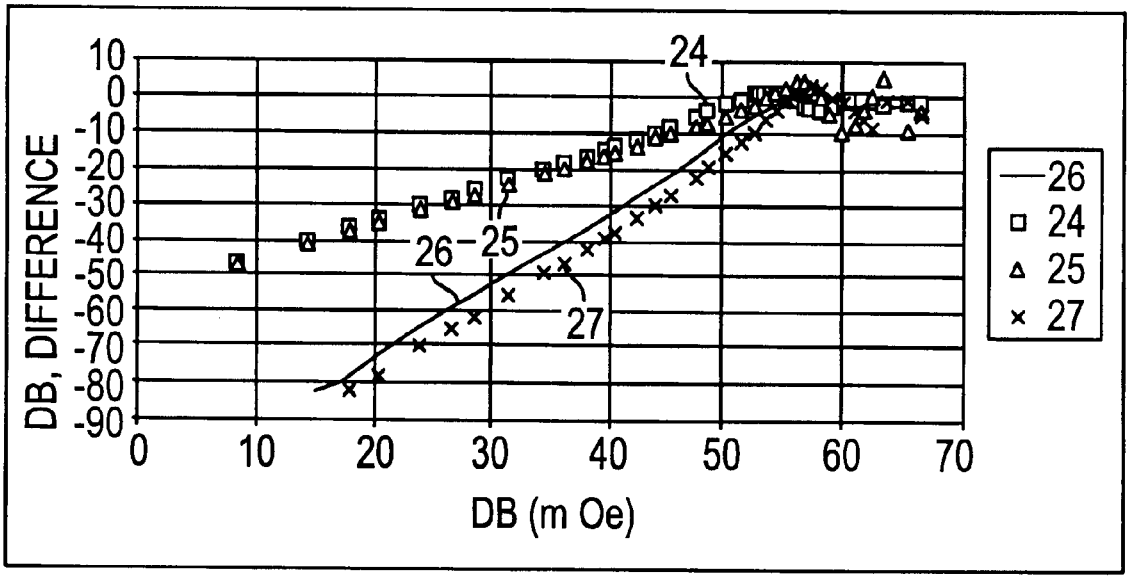
FIG. 10 is a graph showing the signal ratio of the fundamental and its sidebands as a function of the low frequency modulating signal amplitude.

Referring to FIG. 10, the signal ratio of the fundamental frequency and its sideband components are illustrated as a function of the low frequency signal amplitude. The first sidebands are designated as 24 and 25 for left and right, or 200 Hz lower and 200 Hz higher than the fundamental frequency, respectively. The second sidebands are designated as 26 and 27 for left and right, or 400 Hz lower and 400 Hz higher than the fundamental frequency, respectively. By the slope of the curves it is apparent that the first sidebands, 24 and 25, are 30 linearly proportional to the amplitude of the low frequency magnetic field. The secondary sidebands, 26 and 27, are proportional to the square of the low frequency field strength. The response of the marker to the carrier frequency is linear, with an effective permeability of about 20,000.

Therefore, it is clear that the field strength of the low frequency signal determines the ratio between the fundamental and the sideband components. As the low frequency field increases, the first sideband goes up linearly with the field strength of the low frequency signal. The second sideband increases according to the square of the field strength of the low frequency signal. The level of the fundamental depends on the carrier frequency, so that as the low frequency magnetic field strength is increased, the ratio of the sidebands to the fundamental increased. The net energy in the fundamental and the sidebands is determined by the field strength of the carrier signal.

Figure 11:
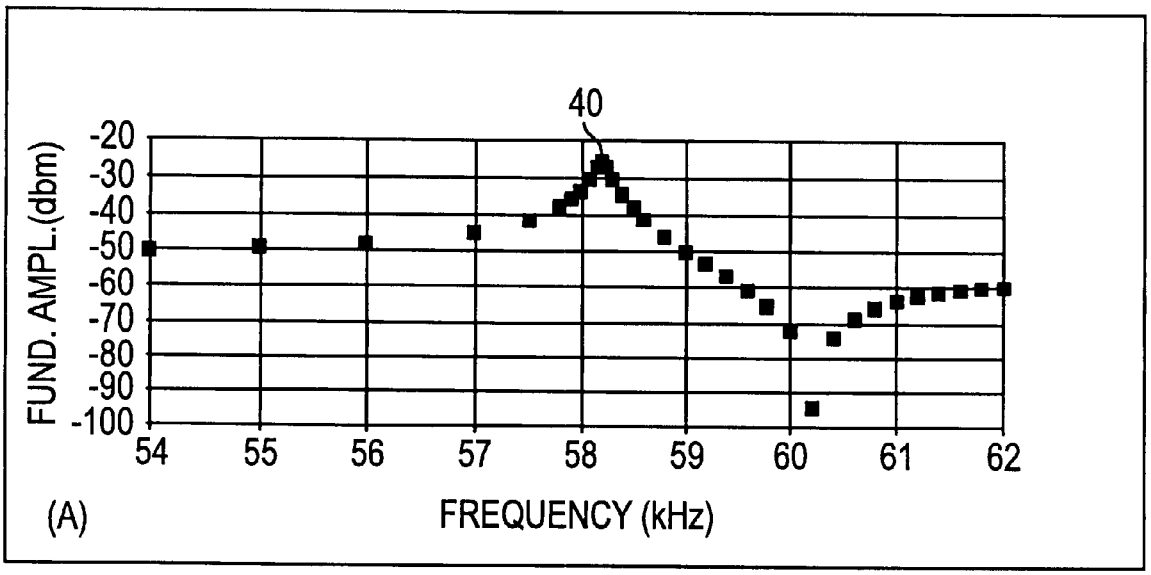
FIG. 11 is a graph of the response of a marker in accordance with the present invention to a swept carrier frequency.

Referring to FIG. 11, the response of marker 2 with respect to the carrier frequency is illustrated. A significant gain in the fundamental component is evident at 40 when the excitation frequency matches the marker's resonant frequency. The response of the fundamental frequency has a maximum 40 at 58.2 kHz in this embodiment.

Figure 12:
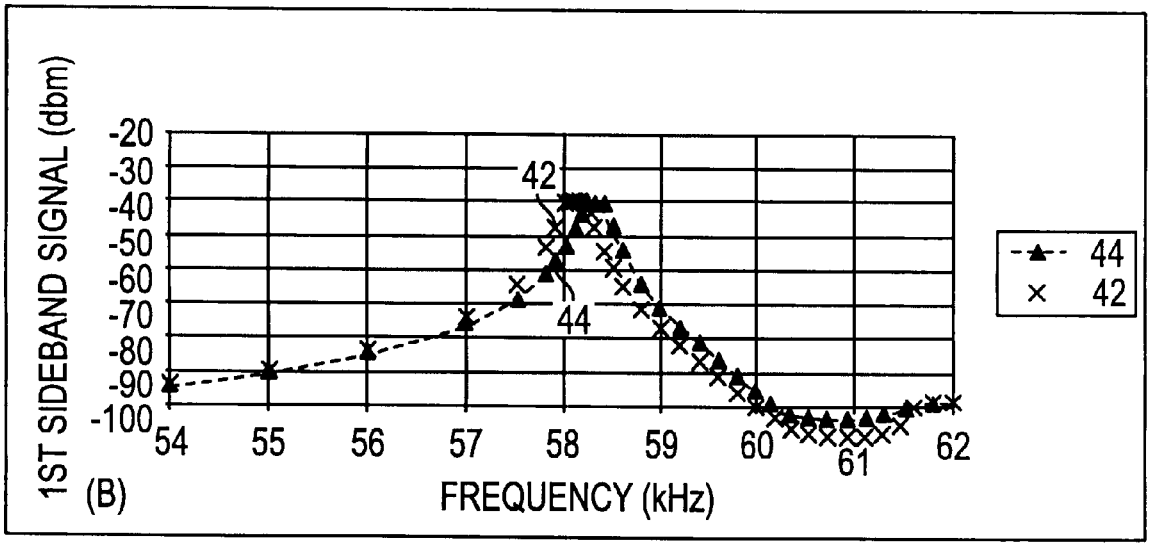
FIG. 12 is a graph of the response of the first sideband as a function of the carrier frequency of a marker in accordance with the present invention.

Referring to FIG. 12, the left first sideband 42 and right first sideband 44 response to the excitation frequency is illustrated. The sideband amplitudes show a significant gain around the marker resonance frequency, with the left first sideband 42 and the right first sideband 44 maximum peaks occurring at 58.0 kHz and 58.4 kHz, respectively.

Referring back to FIG. 1, the modulated sidebands generated by marker 2, as illustrated and described hereinabove, are detectable by receiver 8. Receiver 8 includes a sideband detector that processes modulated sideband signals, which can be implemented in conventional manner as known in the art. A plurality of modulating low frequency signals can be transmitted in separate zones to localize the position of a detected marker 2.

Figure 13:
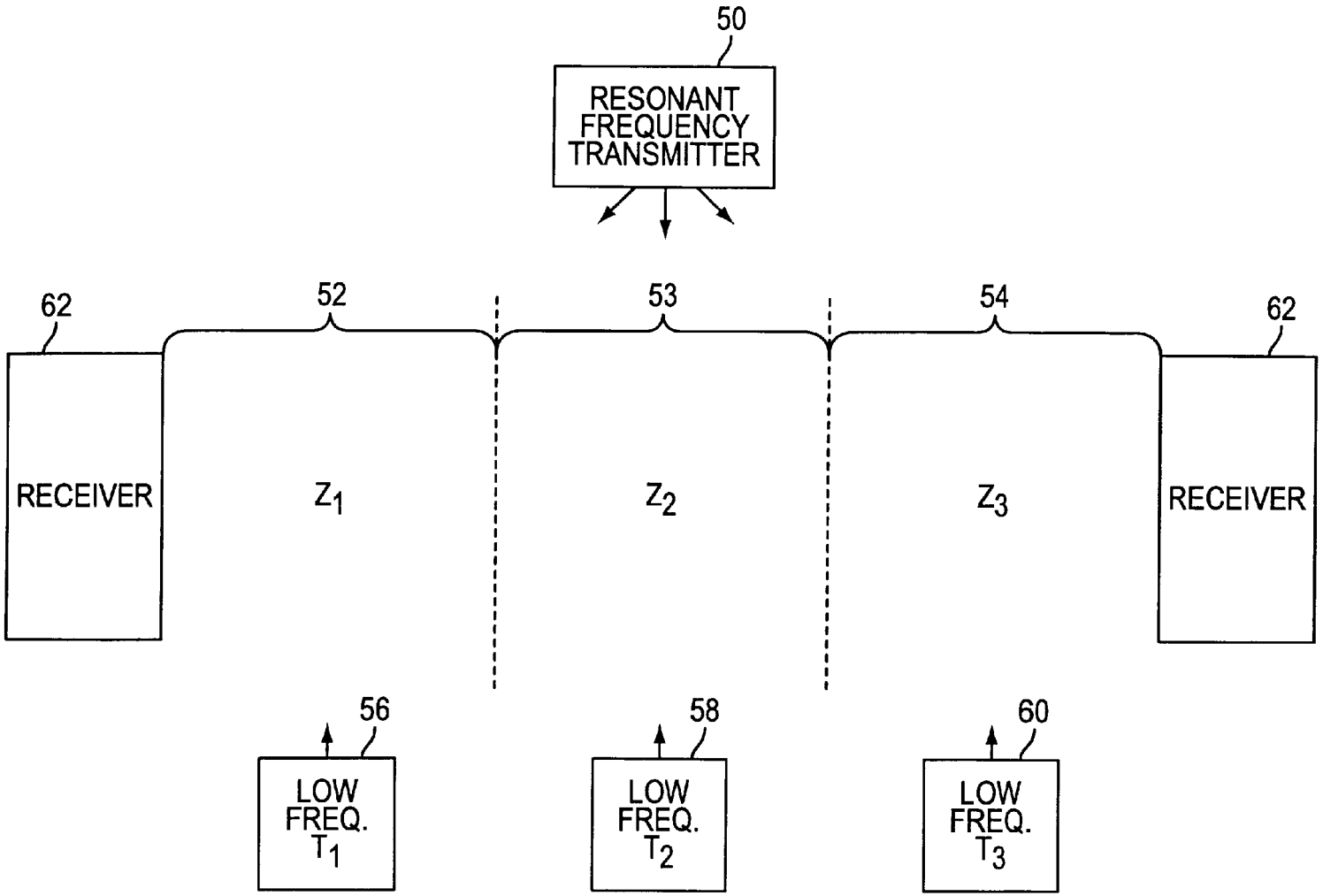
FIG. 13 is a block diagram of an alternate embodiment of an electronic article surveillance system incorporating the present invention.

Referring to FIG. 13, an alternate embodiment for an EAS system incorporating the present invention is illustrated. One or more resonant frequency transmitters 50 transmits a carrier frequency, which, for example, can be 58.2 kHz, into zones 52, 53 and 54. Three zones Z1, Z2, and Z3 are illustrated, but any number of zones can be implemented in accordance with the present invention. Low frequency transmitters 56, 58, and 60, transmit three different modulating frequencies, T1, T2, and T3, which for example can be 200 Hz, 250 Hz, and 300, Hz, respectively. One or more receivers 62 detect the sidebands generated by a marker 2 in any of the zones 52, 53 or 54, as described hereinabove. The detected sideband frequency T1, T2, or T3, such as 200 Hz, 250 Hz, or 300 Hz, will indicate which zone marker 2 was in when detected by receiver 62.

The marker selected and described hereinabove as a preferred embodiment includes mixing capabilities depending upon various excitation conditions such as the modulation frequency and amplitude, the carrier frequency and amplitude, the de bias magnetic field level, and the Q factor. It is clear from the above that the marker carrier and modulation frequencies, the amplitude of the fundamental and sidebands, and the ratio of sideband amplitude to fundamental amplitude are all selectable parameters.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A magnetomechanical electronic article surveillance (EAS) system, comprising:

means for transmitting a first signal alternating at a first frequency and a second signal alternating at a second frequency, said second frequency being lower than said first frequency;

an EAS marker comprising a magnetostrictive ferromagnetic member adapted to resonate at said first frequency when biased by a magnetic field, wherein said second signal modulates the resonance about said first frequency forming and radiating a sideband of said first signal when said marker is exposed to said first signal and said second signal; and, means for detecting said sideband.

2. The system of claim 1 wherein said first frequency is about 58 kHz, and said second frequency is about 200 Hz.

3. The system of claim 1 wherein at least one of said first signal and said second signal is pulsed.

4. The system of claim 1 wherein said magnetic field comprises a dc magnetic field.

5. The system of claim 4 wherein said EAS marker further comprises a magnetizable ferromagnetic member disposed adjacent said magnetostrictive ferromagnetic member, said magnetizable ferromagnetic member providing said dc magnetic field when magnetized.

6. The system of claim 1 wherein said magnetostrictive ferromagnetic member mixes said first and said second signals in a linear magnetic response region of said magnetostrictive member.

7. A method of enhancing the detection of a magnetomechanical electronic article surveillance (EAS) marker of a type having a magnetostrictive ferromagnetic member that resonates at a preselected frequency when exposed to a biasing magnetic field, comprising:

transmitting a first signal alternating at a first frequency and a second signal alternating at a second frequency, said second frequency being lower than said first frequency;

providing an EAS marker comprising a magnetostrictive ferromagnetic member adapted to resonate at said first frequency when biased by a magnetic field, wherein said second signal modulates the resonance about said first frequency forming and radiating a sideband of said first signal when said marker is exposed to said first signal and said second signal; and, detecting said sideband.

8. The method of claim 7 wherein said transmitting step comprises transmitting said first frequency at about 58 kHz, and said second frequency at about 200 Hz.

9. The method of claim 7 wherein said transmitting step comprises transmitting at least one of said first signal and said second signal pulsed.

10. The method of claim 7 wherein providing an EAS marker comprises providing said EAS marker adapted to resonate when biased by a dc magnetic field.

11. The method of claim 10 wherein providing an EAS marker comprises providing a magnetizable ferromagnetic member disposed adjacent said magnetostrictive member, said ferromagnetic member providing said dc magnetic field when magnetized.

12. The method of claim 7 wherein providing an EAS marker comprises providing an EAS marker that mixing said signals in a linear magnetic response region of said magnetostrictive ferromagnetic member.

13. A magnetomechanical electronic article surveillance (EAS) system, comprising:

means for transmitting a first carrier signal alternating at a first frequency and a plurality of second modulation signals alternating at a plurality of second frequencies, said plurality of second frequencies all being lower than said first frequency, each of said second plurality of signals being transmitted into a respective zone;

an EAS marker comprising a magnetostrictive ferromagnetic member adapted to resonate at said first frequency when biased by a magnetic field, wherein each of said second plurality of signals modulates the resonance about said first frequency forming and radiating a sideband of said first signal when said marker is exposed to said first signal and each of said second signals; and, means for detecting said sideband and determining from said sideband which of said plurality of second signals was received by said marker and which zone said marker was in when detected.

14. A method of enhancing the detection of a magnetomechanical electronic article surveillance (EAS) marker of a type having a magnetostrictive ferromagnetic member that resonates at a preselected frequency when exposed to a biasing magnetic field, comprising:

transmitting a first carrier signal alternating at a first frequency and a plurality of second modulation signals alternating at a plurality of second frequencies, said plurality of second frequencies all being lower than said first frequency, each of said second plurality of signals being transmitted into a respective zone;

providing an EAS marker comprising a magnetostrictive ferromagnetic member adapted to resonate at said first frequency when biased by a magnetic field, wherein each of said second plurality of signals modulates the resonance about said first frequency forming and radiating a sideband of said first signal when said marker is exposed to said first signal and each of said second signals;

detecting said sideband; and, determining from said sideband which of said plurality of second signals was received by said marker and which zone said marker was in when detected.

* * * * *

UNITED STATES PATENT AND TRADEMARK OFFICE

CERTIFICATE OF CORRECTION

PATENT NO. : 6,307,474 B1
DATED : October 23, 2001
INVENTOR(S) : Lian et al.

It is certified that error appears in the above-identified patent and that said Letters Patent is hereby corrected as shown below:

Column 5,
Line 38, replace "355" with -- 55 --

Column 6,
Line 44, delete "30"

Column 7,
Line 34, replace "de" with -- dc --

Signed and Sealed this

Twenty-sixth Day of March, 2002

*Attest:*

*Attesting Officer*

JAMES E. ROGAN
*Director of the United States Patent and Trademark Office*